United States Patent [19]

Riley

[11] Patent Number: 4,623,075

[45] Date of Patent: Nov. 18, 1986

[54] CONTAINER FOR PRESSURIZED LIQUID

[75] Inventor: Arthur J. Riley, Stockport, England

[73] Assignee: T.P.T. Limited, Stockport, England

[21] Appl. No.: 690,038

[22] Filed: Jan. 9, 1985

[30] Foreign Application Priority Data

Jun. 21, 1984 [GB] United Kingdom ..... 8415900

[51] Int. Cl.[4] ..... B65D 35/28

[52] U.S. Cl. ..... 222/95; 222/105; 222/394; 222/183; 220/462; 220/407

[58] Field of Search ..... 222/95, 105, 107, 183, 222/386.5, 394, 131; 220/403, 404, 407, 462, 463

[56] References Cited

U.S. PATENT DOCUMENTS

| | | | |
|---|---|---|---|
| 2,950,039 | 8/1960 | Wilson | 220/462 |
| 3,123,254 | 3/1964 | Rabby et al. | 222/131 |
| 3,173,579 | 3/1965 | Curie et al. | 222/105 |
| 3,219,240 | 11/1965 | Campbell | 222/183 |
| 3,349,965 | 10/1967 | Krugger | 222/105 |
| 3,363,807 | 1/1968 | Powell | 222/105 |
| 4,121,737 | 10/1978 | Kain | 222/95 |
| 4,491,247 | 1/1985 | Nitchman et al. | 222/131 |

*Primary Examiner*—H. Grant Skaggs

*Attorney, Agent, or Firm*—Dennison, Meserole, Pollack & Scheiner

[57] ABSTRACT

To prevent a bag-in-box type of container comprising a box enclosing a flexible bag from sagging, bulging or leaking when the bag is filled with a pressurized liquid, such as a carbonated beverage, the bag is located either inside a tube of rigid or inelastic material or inside a closed sleeve of elastic material. With the former, transverse platforms with flanges directed towards respective ends of the box are arranged at each end of the tube to transmit pressure from the tube to the box. With a sleeve of elastic material such platforms are not required, but a slotted platform is usually provided for location of the tap which projects from the bag.

7 Claims, 3 Drawing Figures

CONTAINER FOR PRESSURIZED LIQUID

FIELD OF THE INVENTION

This invention relates to a container for a pressurised liquid, paticularly but not exclusively a carbonated beverage.

BACKGROUND ART

So-called bag-in-box containers are already well known for still table wine. Such a container consists of a substantially impermeable bag, usually of metalised polyester, disposed within a box of cardboard or similar material, the bag being filled with wine and having a tap projecting through the box material so that the wine can be easily dispensed. The great advantage of such a container over a conventional bottle, carafe or the like is that the bag is made of flexible material so that as liquid is dispensed the bag collapses by a corresponding amount and no air is allowed to enter to cause oxidation of the liquid. Progressive oxidation of a beverage such as wine leads, of course, to the beverage firstly becoming stale and subsequently spoiled. Accordingly the bag-in-box packaging keeps the product fresh for an extended period.

A further advantage of bag-in-box containers is that they are lighter than most conventional containers and are therefore more suitable for transporting liquids and/or for holding larger quantities of liquid. The integral tap is also particularly convenient for dispensing the contained liquid and there is no difficulty in the consumer opening the container.

It is desirable to extend bag-in-box packaging to pressurised liquids, particularly carbonated beverages such as beer and soft drinks, so as to achieve, in relation to these liquids, the above-mentioned advantages. However, when such liquids are filled into flexible bags within semi-rigid casings in the form of boxes, the latter have been found to sag or bulge outwardly because of the pressure within the liquid. This is clearly unsatisfactorily as it makes the overall container unstable and likely to topple over and it is not possible to stack the containers for storage or transportation.

OBJECT OF INVENTION

An object of the present invention is to provide a container based on the bag-in-box principle of a flexible bag within a semi-rigid outer casing which will not sag or bulge or leak outwardly when filled with a pressurised liquid.

SUMMARY OF THE INVENTION

With this object in view, the present invention provides a container for pressurised liquid comprising a box-like casing enclosing a flexible bag which is adapted for reception of liquid and has a tap whereby the liquid may be dispensed from the container characterised in that the flexible bag is also located within a substantially cylindrical tube formed of rigid or inelastic material or within a closed sleeve of elastic material.

With a tube of substantially rigid or inelastic material, there is arranged at each end of the tube a respective transverse platform having flanges directed towards the respective end of the casing so as to transmit pressure from the tube to the respective end of the casing.

Preferably, the base of the tap or an outlet member connecting the tap to the bag engages in a slot provided in one of the platforms so as to correctly position the bag within the casing. This also ensures that the tap itself is held securely in an appropriate dispensing position within the casing.

With a closed sleeve of elastic material platforms are not required since the ends of the sleeve are sealed. (One end, of course, must be sealed around the base of the tap which projects for dispensation of liquid). Nevertheless one platform will probably be provided for location of the tap as mentioned above.

Advantageously, the casing is provided with a removable portion defined by perforations in the vicinity of the tap so that prior to purchase of the filled container the tap is tamper-proof, yet after purchase access to the tap is easily achieved by tearing away this portion.

The bag itself is preferably formed of two layers of material, namely an inner layer of polyethylene and an outer covering of nylon/aluminium/polysolefin laminate. The latter material has been found to be particularly effective in preventing escape of carbon dioxide from carbonated liquids within the bag, and preventing the ingress of oxygen into the bag.

Where one or more platforms are present they may be provided with additional flanges or cross walls to strengthen same and assist transmission of pressure from the sleeve or tube to the casing.

BRIEF DESCRIPTION OF THE DRAWINGS

The invention will be described further, by way of example, with reference to the accompanying drawings in which:

As illustrated in FIGS. 1 and 2, a first practical embodiment of the container of the invention comprises an outer casing in the form of a box 10, e.g. a printed corrugated box about 30 cm high and 18 cm by 18 cm in the outer dimensions. The box 10 has overlapping end flaps 11 and a portion 12 defined by perforations 13 extending over the edge between one of the side walls 14 of the box 10 and one of the flaps 11. Two spaced apart apertures (not shown) are also provided in the wall opposing the wall 14 for retention of a handle 28 in the form of a plastics strip having expanded end portions 29 located inside the box 10.

Figure 1:
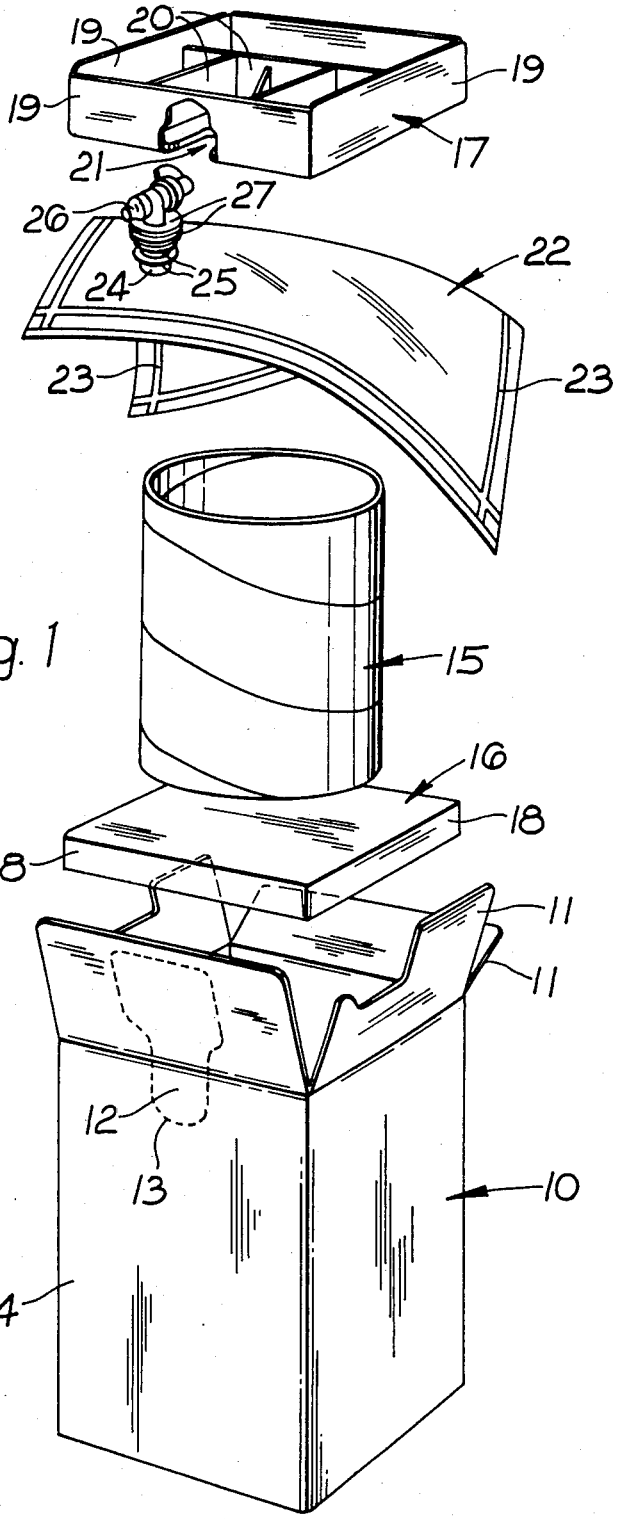
FIG. 1 is an exploded perspective view of a first practical embodiment of the container of invention.

Arranged within the box 10 is a substantially rigid spirally wound cardboard tube 15 of approximately equal diameter to the internal dimensions of the box 10. The tube 15 is supported within the box 10 between respective transverse platforms 16, 17. The platform 16 fits snugly into the base of the box 10 and is in the form of an inverted plastics tray having perpendicular flanges or a rim 18 directed towards the end of the box 10. The other platform 17 is also generally in the form of a plastics tray of similar length and width to the box 10. This platform 17 fits on top of the tube 15 and has perpendicular edge flanges, or a rim, 19 directed towards the top end of the box 10 which is formed by the overlapping flaps 11 when they are secured in position. The platform 17 has a number of additional flanges or cross walls 20, also directed towards the top of the box 10, which serve to strengthen same and assist transmission of pressure from the tube 15 to the top of the box 10. A slot 21 is provided suibstantially midway alone one edge of the platform 17 and extending partially across one flange 19. This slot is disposed adjacent to the perforated portion 12 of the box 10.

Finally, and most importantly, a bag 22 is located within the tube 15. This bag 22 is formed of two inner sheets of linear low density polyethylene and two outer sheets of nylon/aluminium linear low density polyethylene laminate bonded together at 23 adjacent their periphery. The bag 22 has a short cylindrical outlet member 24 with annular ridges 25 and a tap 26, the base of which also carries annular ridges 27, fits into said outlet member 24. By virtue of the annular ridges 25, the outlet member 24 engages into the slot 21 in the upper platform 17. This ensures that the tap 26 is held in the correct position beneath the perforated portion 12 of the box 10 and that the bag 22 is satisfactorily disposed within the tube 15.

It is clear from the drawing that when the container is assembled, the platform 16 and then the tube 15 are placed into the box 10. The bag 22 is then filled with an appropriate carbonated beverage e.g. beer, and the tap 26, which is firmly closed, is inserted into the outlet member 24. The outlet member 24 is then slotted into the platform 17 and these are together placed into the box 10 such that the bag 22 lies within the tube 15 and the platform 17 rests on top of same. The flaps 11 are then closed. As mentioned, the portion 12 defined by perforations 13 lies over the tap 26 and ensures that the contents of the box 10 cannot be tampered with prior to sale to the eventual consumer. When the consumer wishes to dispense the carbonated beverage, he/she simply tears away the portion 12 to reveal the tap 26 which is readily operated. It is envisaged that the tap 26 will be directed downwardly for dispensing the beverage.

The great advantage of the aforesaid container is that by virtue of the tube 15 and the platforms 16, 17, the sides of the box 10 do not sag or bulge outward due to the pressure in the liquid within the bag 22. The tube 15 serves to direct this outward pressure in the longitudinal direction and the platforms 16, 17, transmit same to the end of the box 10. The above-described container, which will hold up to 4.5 litres of liquid, has been found to withstand high pressures of 10 to 20 lb/sq. in (68.96 to 137,90 kpa).

Figure 2:
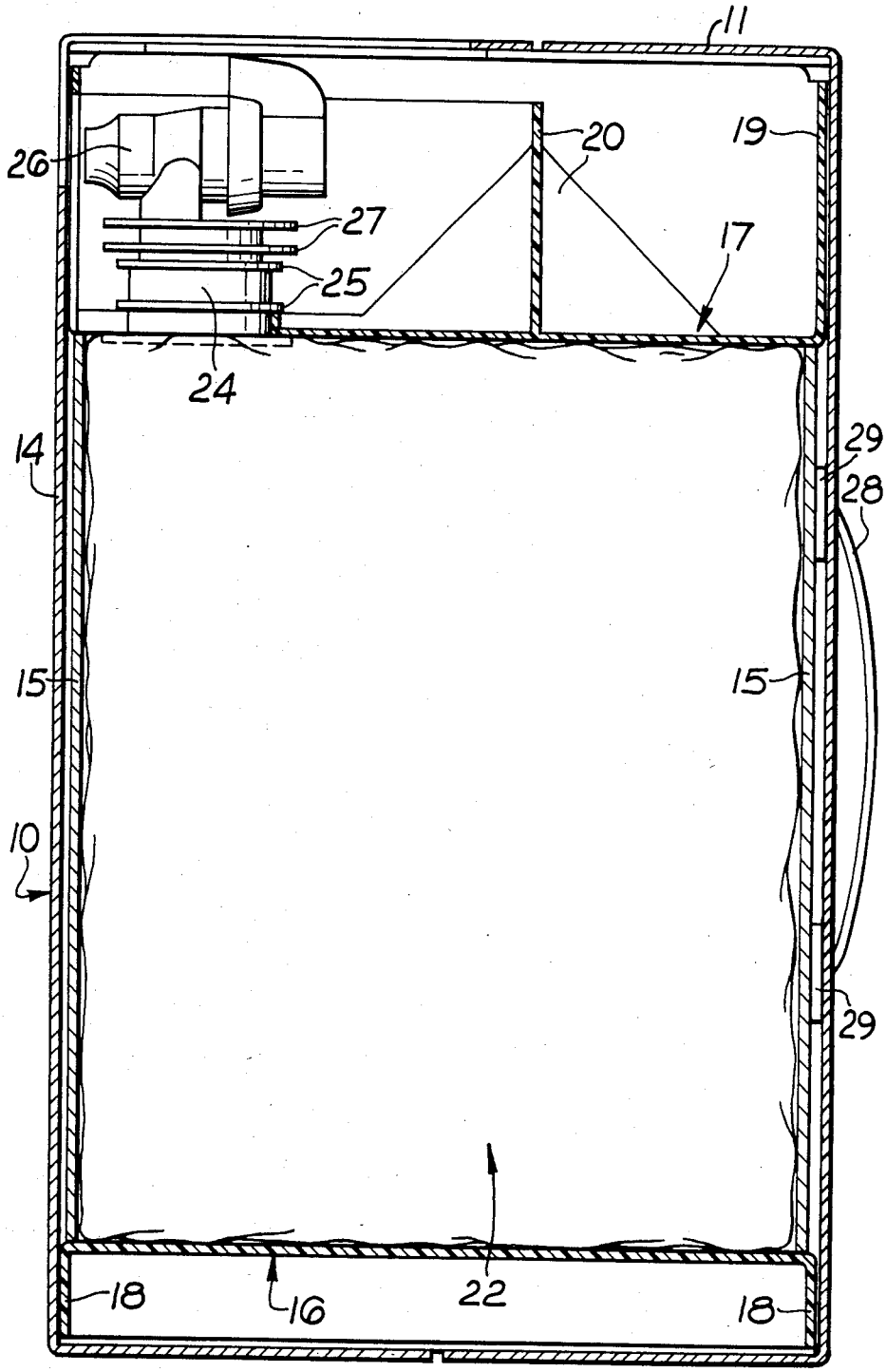
FIG. 2 is a vertical cross-section, to an enlarge scale, of the container of FIG. 1 when fully assembled.

In modifications of the embodiment illustrated in FIGS. 1 and 2, the tube 15 may not be rigid or self-supporting and may be provided by a collapsible component which is stored flat prior to assembly.

Figure 3:
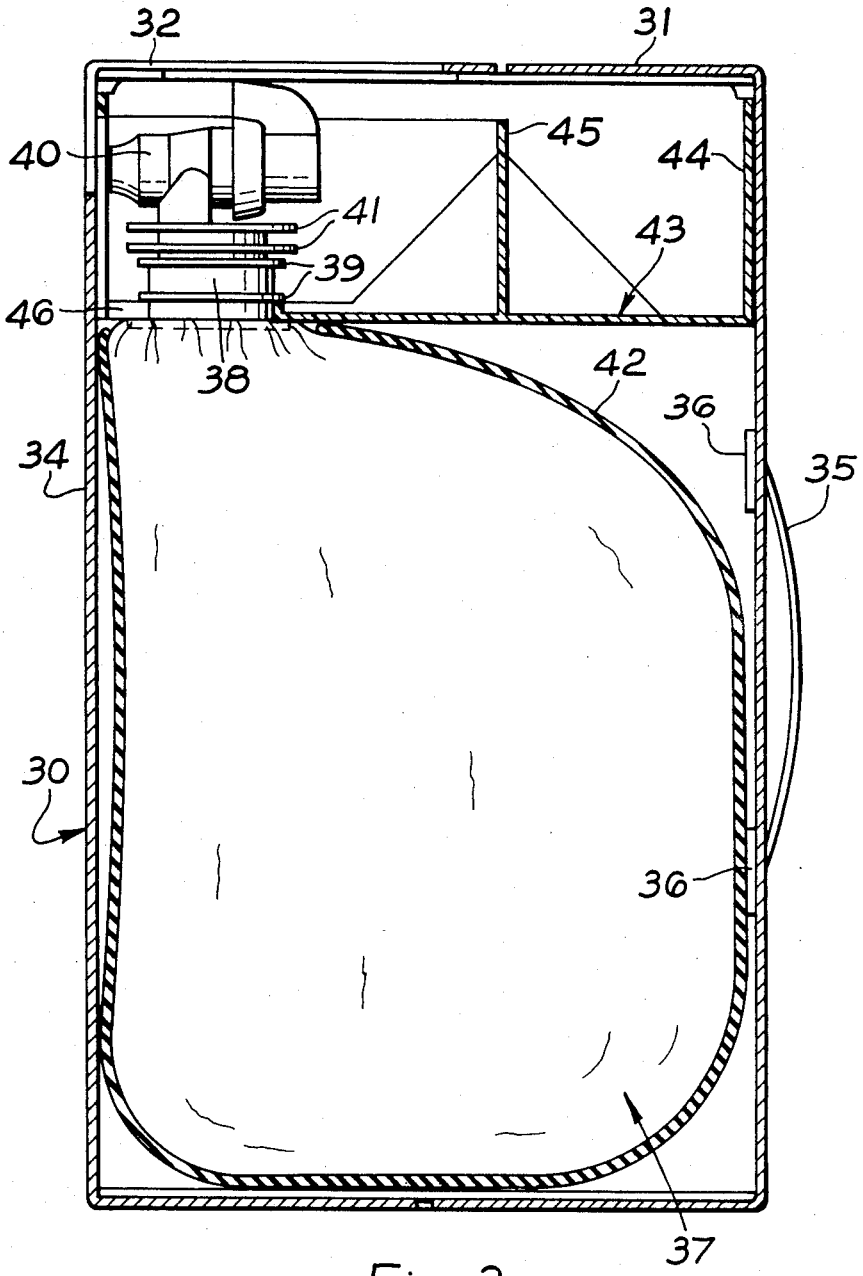
FIG. 3 is a vertical cross-section of a second embodiment of the container of the invention.

A second, alternative, practical embodiment of the container of the invention is illustrated in FIG. 3. This comprises an outer casing in the form of a box 30, having overlapping end flaps 31 and a portion 32 defined by perforations extending over the edge between one of the side walls of the box 30 and one of the flaps 31. Two spaced apart apertures (not shown) are also provided in the wall opposing the wall 34 for retention of a handle 35 in the form of a plastics strip having expanded end portions 36 located inside the box 30.

Inside the box 30 there is a bag 37 formed of two inner sheets of linear low density polyethylene and two other sheets of nylon/aluminium linear low density polyethylene laminate bonded together adjacent their periphery. The bag 37 has a short cylindrical outlet member 38 with annular ridges 39. A tap 40, the base of which also carries annular ridges 41, fits into said outlet member 38.

The bag 37 is enclosed by a sleeve 42 of elastic material e.g. synthetic rubber, which at one end is sealed to the bag 37 adjacent the tap 40 and at the other end is sealed to itself so as to enclose the bag 37. When the bag 37 is filled with a pressurised liquid such as a carbonate beverage, an outwardly-acting force is exerted by the bag 37. However, due to its elastic nature the sleeve 42 exerts a counter-acting inward pressure so that the outer casing 30 does not sag or bulge outwardly. Also, as liquid is dispensed from the bag 37, the sleeve 42 tends to minimise the head space in the bag created by gas coming out of the remaining liquid.

Seated above the bag 37 and sleeve 42 inside the box 30 is a generally square or rectangular platform 43 in the form of a plastics tray having perpendicular edge flanges 44. These flanges 44 are directed towards the top of the box 30 which is formed by the overlapping flaps 31 when they are secured in position. The platform 43 has a number of additional flanges and cross walls 45, also directed towards the top of the box 30, which simply serve to strengthen the platform 43. A slot 46 is provided substantially midway along one edge of the platform 43 and extending partially across one flange 44. This slot 46 is disposed adjacent to the perforated portion 32 of the box 30.

As can be clearly seen from FIG. 3, the tap 40 is held in the correct position beneath the perforated portion 32 of the box 30 by virtue of the annular ridges 39 of the outlet member 38 of the bag 37 engaging into the slot 46 in the upper platform 43.

It is clear from FIG. 3 that when the container is assembled, the bag 37 with the sleeve 42 sealed thereabout is filled with an appropriate carbonated beverage, e.g. beer, and the tap 40, which is firmly closed, is inserted into the outlet member 38. The outlet member 38 is then slotted into the platform 43 and these are together placed into the box 30 such that the platform 43 rests on top of the bag 37 and the sleeve 42. The flaps 31 are then closed. As mentioned, the portion 32 defined by perforations lies over the tap 40 and ensures that the contents of the box 30 cannot be tampered with prior to sale to the eventual consumer. When the consumer wishes to dispense the carbonated beverage, he/she simply tears away the portion 32 to reveal the tap 40 which is readily operated. It is envisaged that the tap 40 will be directed downwardly for dispensing the beverage.

The platform 43 is a fairly tight fit in the box 30 so does not move out of position adjacent the top of the box 30 when the amount of liquid in the bag 37 is reduced i.e. when the bag 37 is no longer full. As mentioned, when liquid is being dispensed from the container via the tap 40, the container will be laid on its side 34, so that the liquid can flow downwards from the tap.

It should be understood that the foregoing is merely illustrative and not limitative of the scope of the invention and many variations are possible. In particular, the materials and dimensions of all the components may differ from those in the described embodiments, and the platforms may have any number of additional flanges or cross walls to improve their strength. Also the bag material may vary. Although it has been found that the nylon/aluminium/polyethylene laminate is particularly effective in preventing loss of carbon dioxide from the contained liquid, other materials may be used or may be found more suitable for retention of other pressurized liquids. Furthermore, the base of the tap, instead of the bag outlet member, may engage the upper platform, although it is not absolutely essential for either to do so.

What is claimed is:

1. A container for pressurised liquid comprising:

a box-like outer casing having at least four side walls and two end walls;

a flexible bag for reception of pressurised liquid, said bag being located within the outer casing and having a tap whereby the liquid may be dispensed; and a substantially cylindrical open ended tube of inelastic material within said outer casing and encircling said bag to preclude transmission of pressure forces generated by the contents of said bag to the side walls of said outer casing and to permit transmission of said pressure forces from said bag to at least one of said end walls of said casing, said container further including a transverse platform arranged within said casing at at least one end of said tube and including at least one flange extending between said end wall of said casing and said tube to transmit pressure from said bag within said tube to said end wall of said casing.

2. A container as set forth in claim 1 wherein means defining a slot is provided in at least one of said transverse platforms configured to engage said dispensing tap on said bag to position said tap and said bag in a predetermined position within said casing between said platform and said end wall.

3. A container as set forth in claim 2 wherein said casing includes a removable portion defined by perforations provided in the casing adjacent the tap.

4. A container as set forth in claim 1 wherein said bag is formed of at least two layers of material, including an inner layer of polyethylene and an outer covering.

5. A container for pressurised liquid comprising:

a box-like outer casing;

a flexible bag for reception of pressurised liquid, said bag being located within said outer casing and having a tap whereby the liquid may be dispensed; and an enclosing sleeve of elastic material substantially surrounding said bag within said casing and having an elastic memory sufficient to counter-act the outward pressure of said bag when filled with pressurised liquid, said container further including a transverse platform positioned within said casing between one end wall thereof and said bag including at least one flange directed towards said one end wall of said casing, means defining a slot in said flange, means defining an outlet member connecting said tap to said bag and positioned within said slot so as to support said tap within said casing in a predetermined position.

6. A container as set forth in claim 5 including a removable portion defined by a pattern of perforations in the casing adjacent the tap.

7. A container as claimed in claim 5 wherein said bag is formed of at least two layers of material, including an inner layer of polyethylene and an outer covering.

* * * * *